US008371043B2

(12) United States Patent
Rusnak

(10) Patent No.: US 8,371,043 B2
(45) **Date of Patent: *Feb. 12, 2013**

(54) SHOES

(75) Inventor: Joel Rusnak, Newburyport, MA (US)

(73) Assignee: Polliwalks, Inc., Sudbury, MA (US)

( * ) Notice: Subject to any disclaimer, the term of this patent is extended or adjusted under 35 U.S.C. 154(b) by 908 days.

This patent is subject to a terminal disclaimer.

(21) Appl. No.: 12/184,417

(22) Filed: Aug. 1, 2008

(65) Prior Publication Data

US 2009/0031587 A1 Feb. 5, 2009

Related U.S. Application Data

(60) Provisional application No. 61/075,778, filed on Jun. 26, 2008, provisional application No. 60/953,246, filed on Aug. 1, 2007.

(51) Int. Cl.
*A43B 23/00* (2006.01)

(52) U.S. Cl. ..... 36/11.5; 36/136; 36/4

(58) Field of Classification Search ..... 36/112, 36/136, 4, 11.5; 12/142 S, 142 RS; D2/897–899, D2/948–952

See application file for complete search history.

(56) References Cited

U.S. PATENT DOCUMENTS

| | | | | | |
|---|---|---|---|---|---|
| 438,179 | A | * | 10/1890 | Quarrie | 101/104 |
| 3,158,558 | A | * | 11/1964 | Bingham, Jr. | 205/72 |
| 3,402,485 | A | * | 9/1968 | McMorrow | 36/25 R |
| 3,538,628 | A | | 11/1970 | Einstein, Jr. | |
| 3,906,642 | A | | 9/1975 | Cohen | |
| 4,050,167 | A | * | 9/1977 | Senter | 36/32 R |
| 4,050,168 | A | * | 9/1977 | Pace | 36/136 |
| 4,279,049 | A | * | 7/1981 | Coiquaud | 12/142 S |
| D260,447 | S | | 9/1981 | Greenblatt et al. | |
| D261,195 | S | | 10/1981 | Weiss | |
| D282,309 | S | | 1/1986 | Valori | |
| D282,310 | S | * | 1/1986 | Valori | D2/899 |
| D290,062 | S | | 6/1987 | Valori | |
| 5,331,753 | A | * | 7/1994 | Rodibaugh | 36/136 |
| 5,465,507 | A | * | 11/1995 | Schumacher et al. | 36/30 R |
| D366,752 | S | | 2/1996 | Sherman | |

(Continued)

FOREIGN PATENT DOCUMENTS

| | | | |
|---|---|---|---|
| CN | 2618470 | Y | 6/2004 |
| CN | 2724453 | Y | 9/2005 |

(Continued)

OTHER PUBLICATIONS

Online webpage, Crocs Footwear, Crocs, Inc. (Niwot, Colorado); Downloaded Aug. 1, 2007, http://shop.crocs.com/c-4-Footwear.aspx?reqid=4&reqProdTypeId=4&subsectionname=footwear.

*Primary Examiner* — Marie Patterson

(74) *Attorney, Agent, or Firm* — Antoinette G. Giugliano; AGG Intellectual Property Law

(57) ABSTRACT

The present invention relates to a molded shoe featuring a 3 dimensional figure (e.g., an animal or character). The shoe has a sole having a bottom surface that comprises a series of projections and recesses that form a print for an animal or character, to thereby obtain an imprinting surface; and an upper, attached to the sole, having an outer surface that comprises a series of projections and recesses that form a three dimensional figure (e.g., an animal figure or a character figure). The sole and upper are substantially formed from molded plastic; the projections and recesses of the animal imprinting surface allow one wearing the shoe to make imprints on a soft surface, and the three dimensional figure on the outer surface of the upper relates to the print of the imprinting surface. The methods of the present invention further include making imprints with the bottom surface of the shoe.

15 Claims, 4 Drawing Sheets

U.S. PATENT DOCUMENTS

| | | | | | |
|---|---|---|---|---|---|
| D378,009 | S | * | 2/1997 | Sullivan et al. | D2/917 |
| D381,795 | S | | 8/1997 | Coats | |
| D393,937 | S | * | 5/1998 | Henson | D2/899 |
| D394,137 | S | | 5/1998 | Nadel | |
| 5,765,300 | A | | 6/1998 | Kianka | |
| D397,541 | S | * | 9/1998 | Henson | D2/899 |
| 5,814,254 | A | | 9/1998 | Bisconti | |
| 5,837,174 | A | | 11/1998 | Bisconti | |
| 5,868,981 | A | | 2/1999 | Bisconti | |
| 5,974,694 | A | | 11/1999 | Vecchiola | |
| 5,980,351 | A | | 11/1999 | McCook | |
| D418,663 | S | | 1/2000 | Senif | |
| D422,778 | S | | 4/2000 | Yang | |
| D423,197 | S | | 4/2000 | Yang | |
| 6,080,033 | A | * | 6/2000 | Fladwood et al. | 446/26 |
| 6,189,240 | B1 | * | 2/2001 | Cowgill et al. | 36/112 |
| D479,386 | S | * | 9/2003 | Gebhardt | D2/898 |
| D487,614 | S | | 3/2004 | Le | |
| D489,516 | S | | 5/2004 | Gebhardt | |
| D490,218 | S | | 5/2004 | Gebhardt | |
| D498,038 | S | | 11/2004 | Gebhardt | |
| D498,907 | S | | 11/2004 | Gebhardt et al. | |
| D498,908 | S | | 11/2004 | Gebhardt et al. | |
| 6,957,504 | B2 | | 10/2005 | Morris | |
| 6,993,858 | B2 | | 2/2006 | Seamans | |
| D517,788 | S | | 3/2006 | Seamans | |
| D517,789 | S | | 3/2006 | Seamans | |
| D517,790 | S | | 3/2006 | Seamans | |
| D521,217 | S | | 5/2006 | Mochring et al. | |
| D525,017 | S | | 7/2006 | Ochoa | |
| D525,419 | S | | 7/2006 | Seamans | |
| D529,263 | S | | 10/2006 | Wolf | |
| D532,188 | S | | 11/2006 | McClaskie | |
| 7,146,751 | B2 | | 12/2006 | Seamans | |
| D535,088 | S | | 1/2007 | Seamans | |
| D543,681 | S | | 6/2007 | McCarthy | |
| D544,182 | S | | 6/2007 | McClaskie | |
| D547,540 | S | | 7/2007 | Maderspach | |
| D549,434 | S | | 8/2007 | Seamans | |
| D567,482 | S | | 4/2008 | Hoyt | |
| D604,031 | S | * | 11/2009 | Andersen et al. | D2/952 |
| 2002/0083623 | A1 | * | 7/2002 | Joseph | 36/122 |
| 2002/0166258 | A1 | * | 11/2002 | Posa | 36/11.5 |
| 2004/0231190 | A1 | | 11/2004 | Seamans | |
| 2006/0048407 | A1 | * | 3/2006 | Seamans | 36/3 R |
| 2007/0130797 | A1 | | 6/2007 | Seamans | |

FOREIGN PATENT DOCUMENTS

| | | | |
|---|---|---|---|
| CN | 2761006 | Y | 3/2006 |
| FR | 2343395 | | 9/1977 |
| WO | WO 02/052972 | | 7/2002 |
| WO | WO 2004/064556 | A2 | 8/2004 |

* cited by examiner

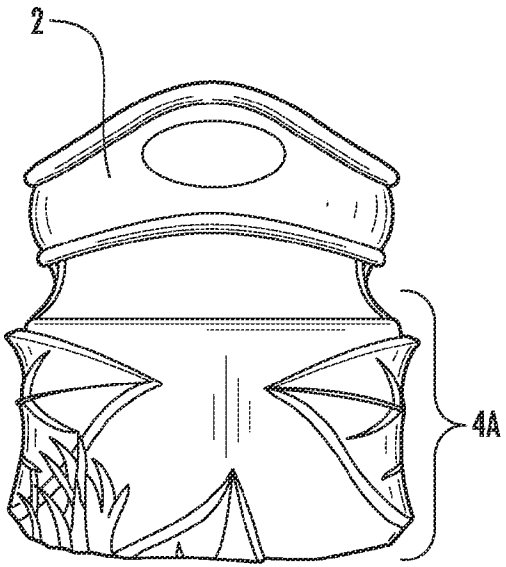
FIG. 1C
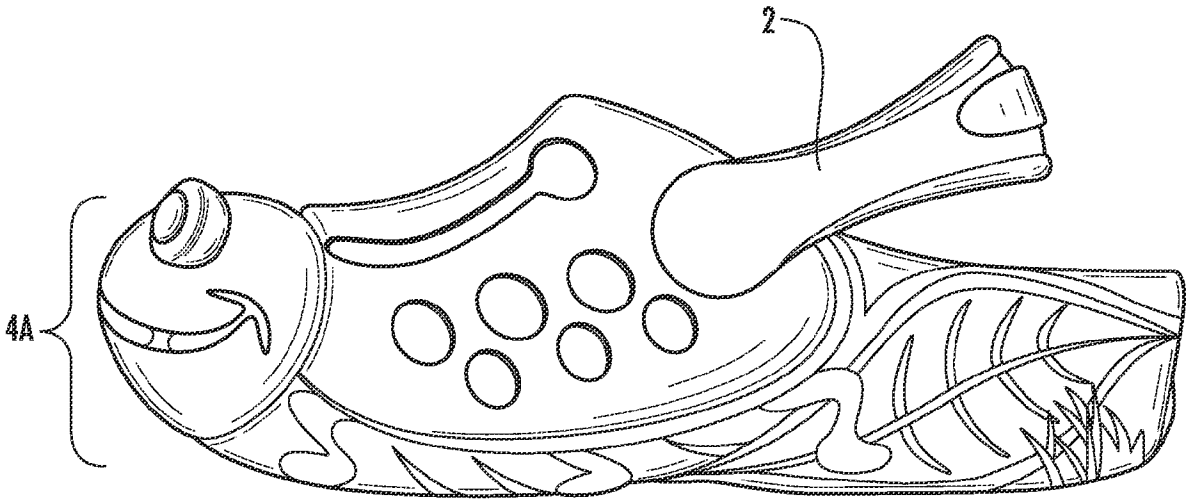
FIG. 1A
FIG. 1B
10
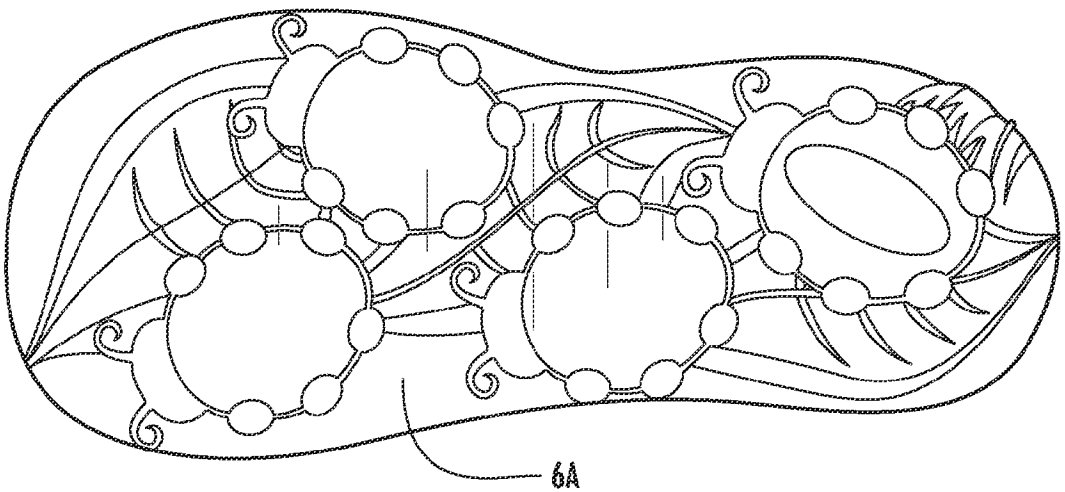

20

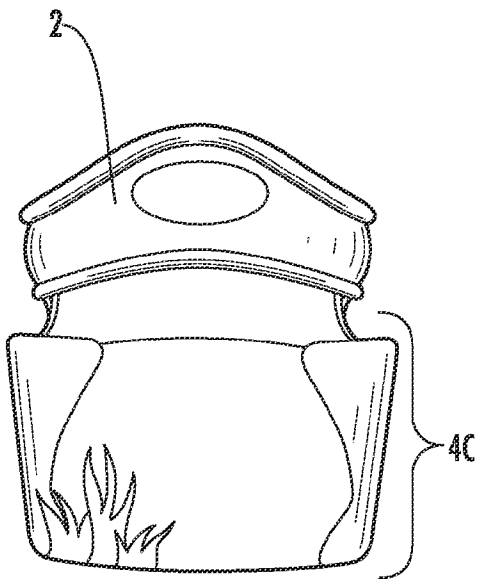
FIG. 3C
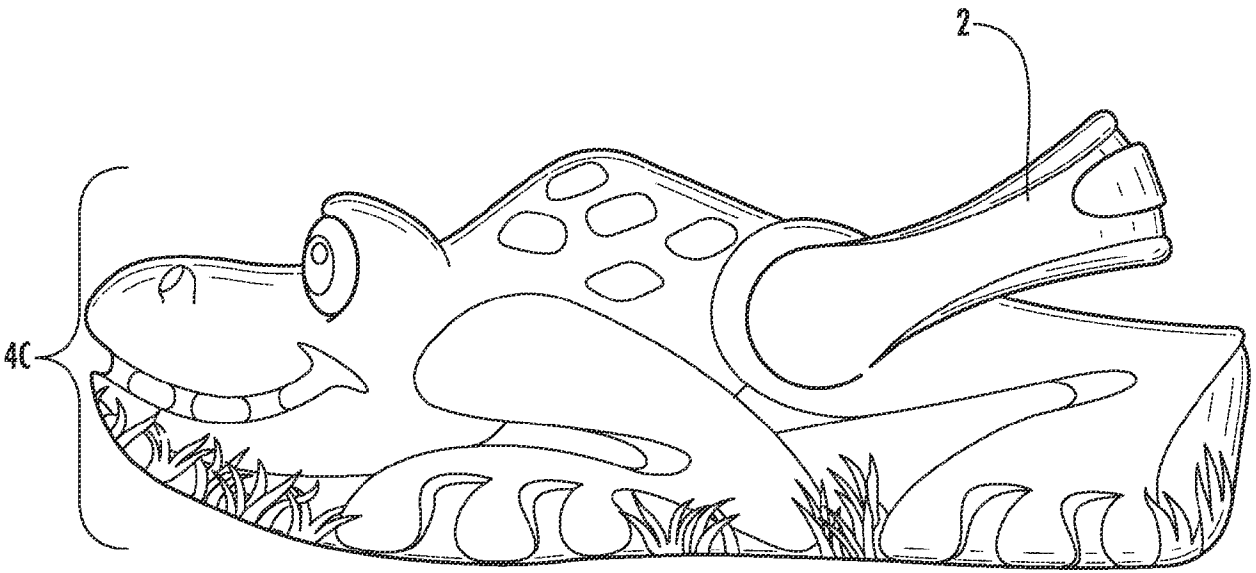
FIG. 3A
FIG. 3B
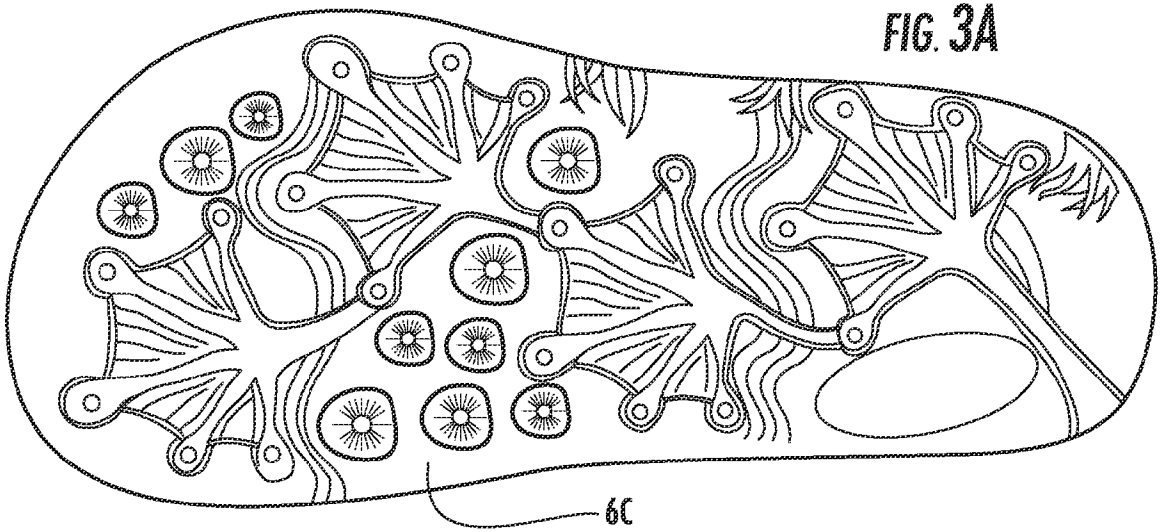
40

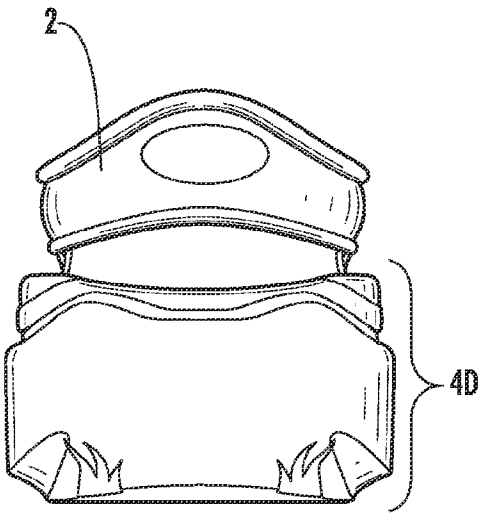
FIG. 4C
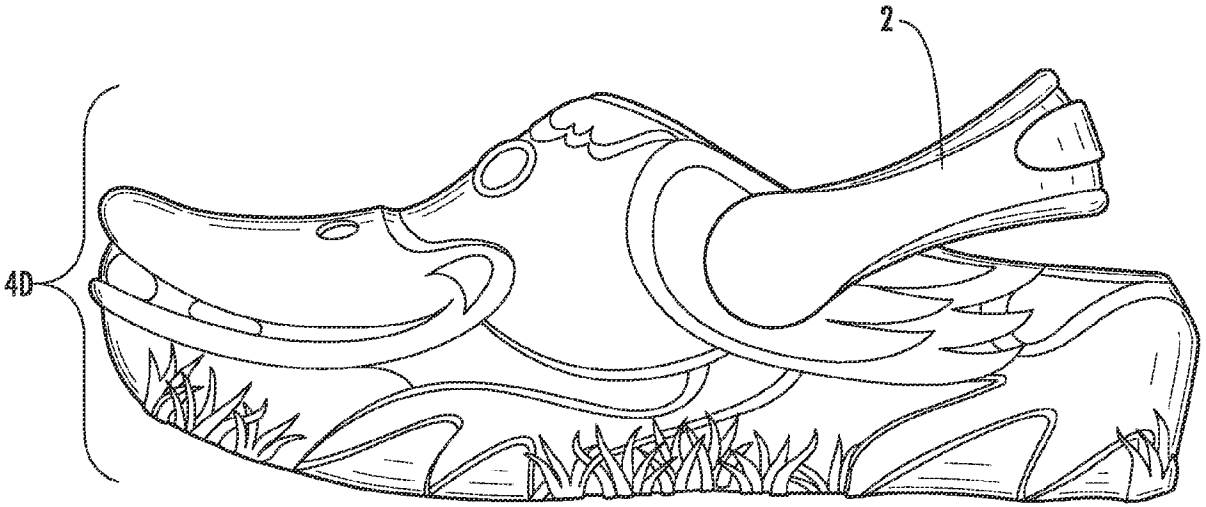
FIG. 4A
FIG. 4B
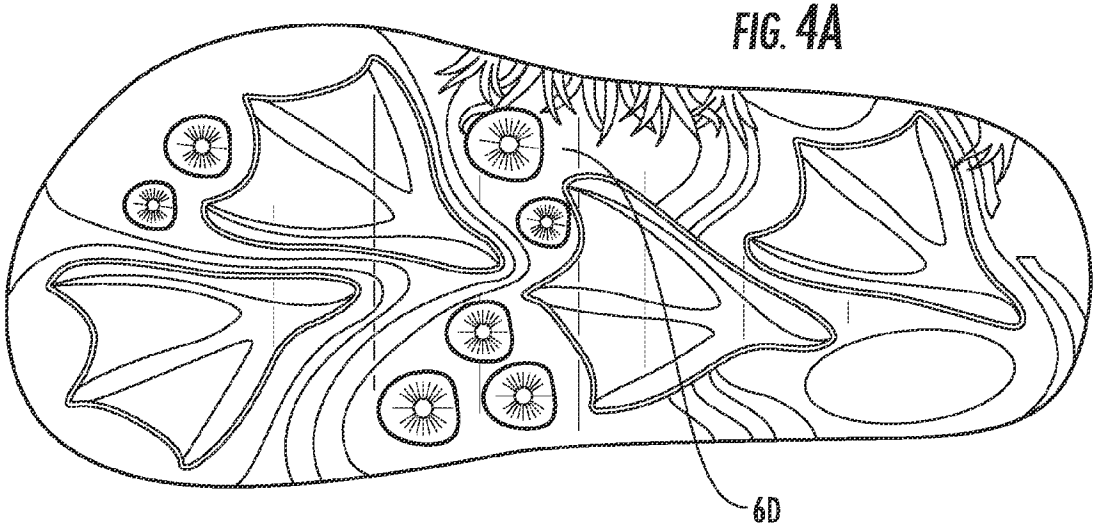
60

SHOES

RELATED APPLICATION

This application claims the benefit of U.S. Provisional Application No. 61/075,778 entitled "SHOES" by Joel Rusnak, filed on Jun. 26, 2008, and U.S. Provisional Application No. 60/953,246, entitled "ANIMAL PRINT MAKING SHOES" by Joel Rusnak, filed on Aug. 1, 2007.

The entire teachings of the above applications are incorporated herein by reference.

BACKGROUND OF THE INVENTION

Shoes for children many times can lack a fun theme and/or three dimensional design. Children enjoy exploring and learning about new things. In particular, many children have a love of animals and characters, and like to learn about them.

A need exists for shoes that have three dimensional, fun themes. In particular, a need exists for shoes that have a three dimensional animal or character figure integrated into them. A further need exists to make a three dimension animal/character shoe that also makes imprints.

SUMMARY OF THE INVENTION

The present invention relates to a molded shoe featuring a 3 dimensional figure. The shoe has a sole having a bottom surface that comprises a series of projections and recesses (e.g., contours) that form a print (e.g., an animal print, which include animal footprints or animal tracks), to thereby obtain an imprinting surface. The shoe further includes an upper, attached to the sole, having an outer surface that comprises a series of projections and recesses that form a three dimensional figure (e.g., an animal figure, character figure, or a figure that reflects a person's likeness). The recesses and projections of the figure of the upper is integrated with the sole, and the depth of the projections, recesses, or both of the upper range between e.g., about 2 mm to about 20 mm (preferably between about 3 mm and about 10 mm). The sole and upper, in an aspect, are substantially or fully formed from molded plastic. Also, the projections and recesses of the imprinting surface (e.g., animal imprinting surface) allow one wearing the shoe to make imprints on a soft surface or hard surface when sole is wet. Preferably, and the figure on the outer surface of the upper relates to, corresponds to, or otherwise correlates with the print of the imprinting surface. The molded plastic, in an embodiment, made of recyclable material and is recyclable. In an aspect, the figure is an animal figure or a 3-dimensional character figure. The animal figure of the upper includes e.g., a ladybug, an alligator, a frog, a duck, a dinosaur, bugs (e.g., a firefly and a bee), a turtle, a panther and fish.

In one aspect, the animal imprinting surface can be of footprints of the animal figure that forms the upper. The imprinting surface has projections, recesses, or both that have a depth that ranges between about 2 mm to about 10 mm (e.g., between about 2 mm and 5 mm) to thereby obtain an imprinting surface. The shoes can further include a strap for wrapping around the back of the ankle, wherein the strap has a first and second end attached to the upper. The upper includes a series of projections and recesses that form a three dimensional figure that has an eye, a mouth, animal skin pattern, feathers, scales, nose, teeth, grass, toes, feet, ears, fur, mouth, claws or any combination thereof.

An aspect of the invention includes the three dimensional figure (e.g., animal figure) integrated into the upper using the series of projections and recesses, as described herein, independent of the prints on the bottom surface of the shoe. Similarly, an embodiment of the present invention includes the series of projections and recesses that make the imprint (e.g., animal imprint) on the bottom surface of the sole, independent of the three dimensional figure of the upper. In yet another embodiment, the present invention relates to a shoe that has both.

The present invention further includes methods of making an imprint on a surface with a molded shoe, as described herein. The methods include stepping on the surface with a molded shoe of the present invention, as described herein. The surface is a soft surface that includes dirt, mud, sand or clay. In an embodiment, the method further includes coating the bottom surface with a print making solution, and stepping on to a surface like paper to make imprints. In yet another embodiment, the method includes wetting the bottom surface of the shoe and stepping on a dry surface to make the imprints.

The present invention has several advantages. Children can now enjoy shoes with three dimensional animals or figures integrated within the shoe. At the same time, children can learn and/or make foot prints of the animal or character while wearing the shoe.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

FIG. 1A-1C are schematic drawings of a side view, bottom view and a back view, respectively, of a molded shoe featuring a ladybug.

FIG. 2A-1C are schematic drawings of a side view, bottom view and a back view, respectively, of a molded shoe featuring an alligator.

FIG. 3A-1C are schematic drawings of a side view, bottom view and a back view, respectively, of a molded shoe featuring a frog.

FIG. 4A-1C are schematic drawings of a side view, bottom view and a back view, respectively, of a molded shoe featuring a duck.

DETAILED DESCRIPTION OF THE INVENTION

Figure 2C:
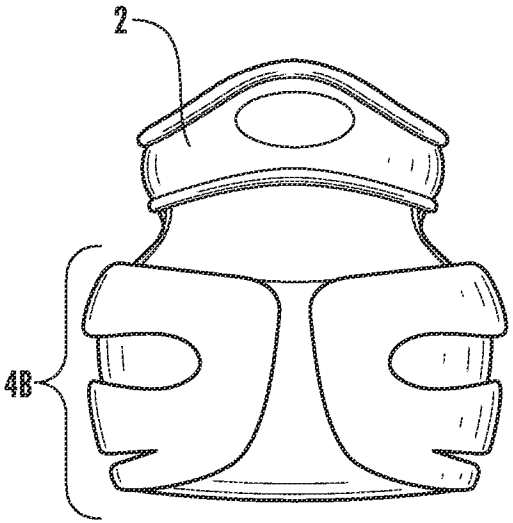

A description of preferred embodiments of the invention follows.

The present invention relates to a molded shoe that features a three dimensional figure. In an embodiment, the three dimensional figure can be an animal, a character, or of a person's likeness. The molded shoe of the present invention includes a series of projections and recesses that form a pattern (e.g., an animal pattern or a character pattern) on the bottom surface of the sole, and/or has a three dimensional figure integrated into the upper or any portion of the shoe. (e.g., tops of the shoe, sides of the shoe, the back of the shoe).

As referred to herein, a sole is a portion of the shoe that forms the bottom part of the shoe; the part on which the foot rests. The sole has a bottom surface that comes into contact with the ground or floor, or other surface on which a person is walking. Another portion of the shoe is the upper. The upper, also known as a vamp, is the portion of the shoe that holds the shoe onto the foot. In an embodiment, the upper is the portion of the shoe that covers the toes, the instep, the back of the foot, and/or the sides of the foot. A shoe includes footwear such as clogs, boots, sandals, and the like.

In an embodiment, the molded shoe of the present invention includes a sole having a bottom surface. The bottom surface can be shaped such that all or a portion of the surface comes into contact with the ground. In the case of a flat shoe, all or substantially all of the surface comes in contact with the walking surface, whereas in the case of a heel, portions (e.g., the ball of the foot and the heal) of the shoe comes into contact with the walking surface. The bottom surface of the molded shoe of the present invention has a series of projections and recesses that form various imprinting surfaces featuring a print that correlates to the three-dimensional figure, such as an animal print or character print. The projections and recesses are shaped and contoured to form the print. The print (e.g., animal print) can include variety of items related to the three dimensional figure of the upper, e.g., foot prints, tracks, leaves, animal shapes, lily pads, grass, and any combination thereof. Other animal related items can form the imprinting surface of the shoe of the present invention. In a preferred embodiment, the animal print on the bottom surface includes a footprint of the featured animal (e.g., the animal that forms the three dimensional portion of the upper).

The projections and recesses (e.g., indentations) on the sole are deep enough to make an imprint on a surface. In an embodiment, the projections, recesses or both have a depth that ranges between about 2 mm to about 10 mm (e.g., preferably between about 2 and 5 mm). In an embodiment, the surface on which the imprint is made is a soft surface, such as dirt, sand, or mud. In another embodiment, the surface can be a hard or non-spongy surface, and the bottom surface of the shoes of the present invention can be coated with an imprinting solution (e.g., washable paint). In yet another embodiment, the bottom surface can be coated with a solution that only appears on paper that reacts to the solution. Still in another embodiment, the bottom surface can be wetted and prints can be made on a dry surface.

The present invention, in an aspect, further includes an upper that has an outer surface (e.g, an outer layer) with a series of projections and recesses that form an animal figure, a character figure or other 3 dimensional figure. The 3 dimensional figure can be integrated into all or any portion of the shoe upper which includes the portions which cover the instep, the toes, the back of the foot, and the sides of the foot. The figure (e.g., animal figure), in an embodiment, has eyes, mouth, nose, ears, hair, feathers, scales, wings, a skin pattern, grass, and any combination thereof. The figure is a three dimensional figure that is integrated with the upper, as compared to two dimensional pictures or drawings that are printed onto the shoe. The projections and recesses are contoured and shaped to form the three dimensional figure. The shoe of the present invention can be formed into any animal figure, and some examples shown in the figures include a ladybug, alligator, frog and duck. Additional animal figures can be formed as part of the shoe, as described herein, and they include dinosaurs, tigers, lions, snakes, penguins, dragons, giraffes, elephants, pandas, bears, butterflies, dragonflies, hippopotamus, bugs (e.g., a firefly and a bee), a turtle, a panther, fish, etc. or any other animal. Examples of types of dinosaurs include triceratops, archaeopteryx, compsognathus, tyrannosaurus, apatosaurus, ichthyosaurs, mosasaurs, plesiosaurs, pterosaurs, dimetrodon, ankylosaurus, dimetrodon, ammosaurus and iguanodon. In an embodiment, the figure can be of a character (e.g., fictional or non-fictional character). Examples of fictional characters include those seen in cartoons, plays, on TV shows, and the like. Characters further include using the likeness of a person including famous persons. The three-dimensional figure of the upper includes three dimensional characters having general overall features, shape, likeness of the person or character (e.g., hats, hairstyle, accessories, instruments, clothing, and the like). The shoes can be of any color or color combination. An aspect of the invention includes a shoe with an upper having a three dimensional figure or animal integrated therein.

Referring to FIGS. 1A-C shows ladybug shoe 10 of the present invention. FIG. 1A shows a side view of the molded shoe and has strap 2 and lady bug upper 4A which is formed by a ladybug's body which includes a mouth, eyes, and wings having a wing pattern. The shoe design further includes ladybug feet, leaves and grass. The ladybug shape is formed from a series of projections and recesses that are integrated into a three dimensional animal figure of the upper. The upper can further include openings e.g., to accentuate the animal pattern such as the wing pattern.

The shoe shown in the figure is a clog. However, the shoe can be embodied in other types of shoes such as sandals, boots, closed shoes and other types known in the art.

The shoe further includes strap 2, when worn, wraps round the back of the ankle. The strap has two ends, each end attaching to a portion of the upper. The strap can be stationary or pivot. Additionally, the strap can be made of molded plastic, or from another material (e.g., cloth, leather), or combination thereof. The strap can use an attaching and/or adjustable means that include a buckle, snaps, velcro, buttons, fasteners, or other methods known in the art or later developed. The strap can be attached directly or indirectly. For example, washers can be used to indirectly connect the strap end and the shoe to allow the strap to more easily rotate.

In a preferred embodiment, the shoe and the strap is made from molded plastic, or a material that is recyclable. The shoe of the present invention, in one aspect, is made of recyclable material and is recyclable. The shoe can further include a logo, trademarks or a recycle symbol on any part of the shoe including the bottom imprinting surface.

The bottom surface of sole 6A shown in FIG. 1B shows an animal imprinting surface. This particular surface shows series of ladybugs on leaves. Hence, when a person or child wearing the shoes walks on a soft surface, an imprint of ladybugs on leaves will be made. In addition to an outline of the featured animal, animal footprints can form the imprint surface (see soles 6B, 6C, and 6D of FIGS. 2B, 3B, and 4B, respectively). Other animal figures that form the imprinting surface of the present invention include animal symbols, names, habitats, (e.g., grass, leaves, rocks, water), animal outlines, and the like. The animal figures that form the imprinting surface can be repetitive or non-repetitive. In a preferred embodiment, the animal imprinting surface on the bottom surface of the sole relates to or matches the animal figure of the upper. For example, webbed feet imprinting surface with a duck animal figure is used in an embodiment. The animal print of the imprinting surface relates to the anatomy, habitat or way of life of the featured animal of the upper.

Figure 2A:
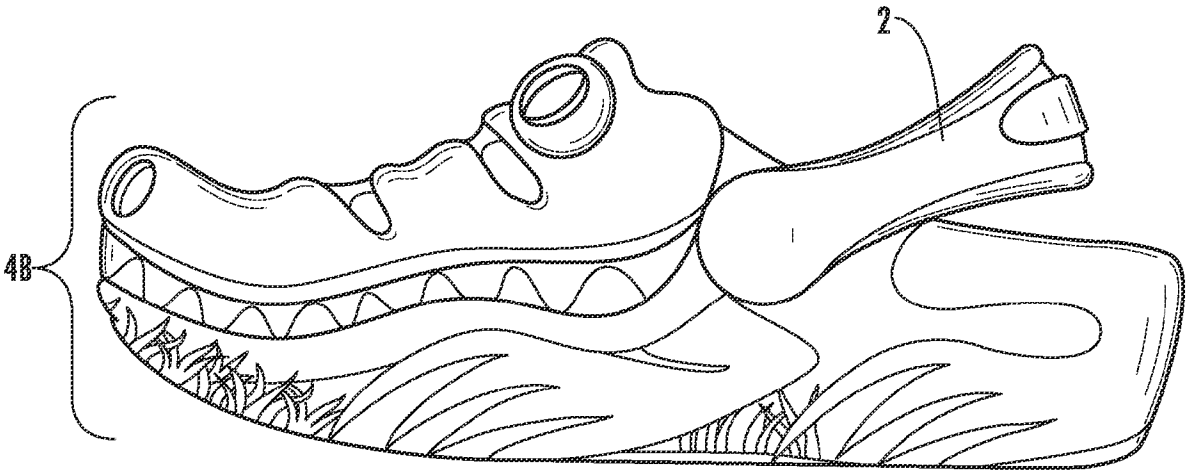
Figure 2B:
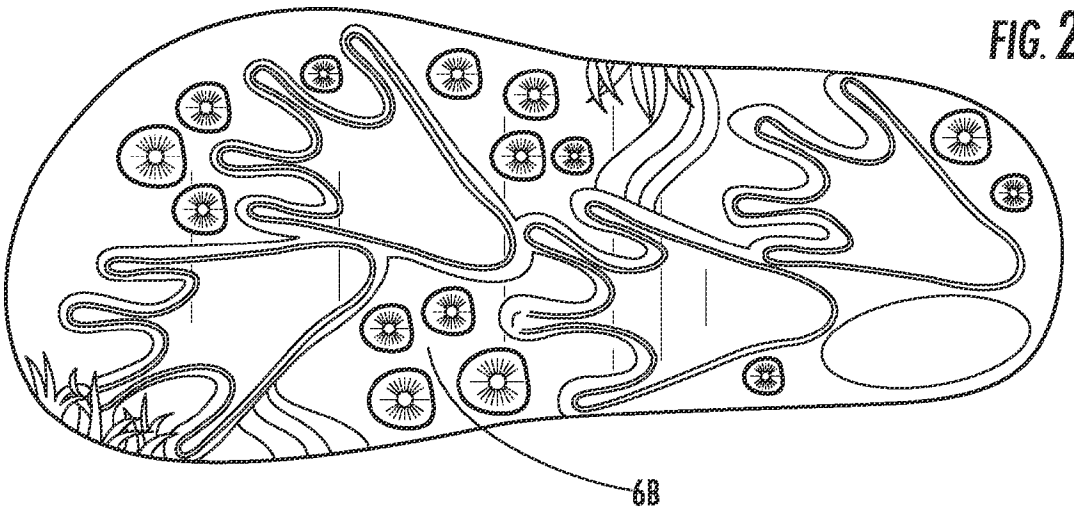

Referring to FIGS. 2A-2C, alligator shoe 20 of the present invention features an alligator. In these figures, alligator upper 4B includes contours (e.g., projections and recesses) that shape the alligator's mouth, teeth, beak, eyes, and skin pattern. The projections and recesses are further shaped to include swamp-like grass. The bottom imprinting surface of sole 6B has a series of contours that form alligator feet and lily pads.

Similarly, FIGS. 3A-C shows the plastic molded frog shoe 40 of the present invention in which the contours form a three dimensional frog. Frog upper 4C includes projections and recesses that are shaped to include a mouth, eyes, nostrils, the frog's skin pattern (e.g., bumpy), and its habitat that includes grass. The imprinting surface of sole 6C has projections and recesses that form webbed feet, lily pads and grass.

A three dimensional duck figure is the focus of duck shoe 60 shown in FIGS. 4A-C. Duck upper 4D's projections and recesses form the ducks beak, nostrils, mouth, eyes, feathers, and grass, while the corresponding bottom surface of sole 6D is shaped to formed duck feet, lily pads, and grass.

The material of the molded shoe is preferably a molded plastic, but can be made of rubber, vinyl, thermoplastic material, thermosetting plastic material, or any other material that can be molded. The invention can use any molded plastic. In an embodiment, the shoes of the present invention are an injection molded Ethylene Vinyl Acetate (EVA). EVA, is a copolymer of ethylene and vinyl acetate. EVA is a polymer that is soft and flexible, and processed like a thermoplastic. EVA is commercially available from a number of retailers including Dupont. Injection molding is a manufacturing technique that uses materials such as thermoplastic and thermosetting plastic materials. Molten plastic is injected at high pressure into a mold, which is the inverse of the shoe's shape (e.g., an inverse of the three dimensional contours of the animal figure and the inverse of the corresponding animal imprint on the bottom imprinting surface). After an embodiment of the present invention is designed, molds are made e.g., from metal, usually either steel or aluminum, and precision-machined to form the features of the shoe.

The shoe of the present invention, in an aspect, is made in part or in whole from a material that is recyclable. In a preferred embodiment, the whole shoe including the strap and optionally the means for securing the strap is made from a recyclable material.

The present invention includes method of printing animal prints on a surface using the shoes of the present invention. The method involves the user who is wearing the shoe stepping on a surface. The act of stepping or applying pressure to the bottom imprinting surface of the shoe creates an impression on the surface. The surface can be a soft or spongy surface, such as soft dirt, mud, and sand. The depth of the indentations (e.g., the protrusions and recesses) that form the animal print on the bottom surface of the shoe allows one to make an impression or imprint on the surface. The method further includes first placing the shoe on the wearer's feet. Alternatively, the imprints can be made on a harder or flat surface when surface is coated with a print making solutions (e.g., washable paint). In yet another embodiment, solutions which reacts only to the surface on which the user is stepping to show color. Another embodiment is wetting the bottom surface of the shoe and making prints on a dry surface such that the print can be seen when wet.

Exemplification

The shoes shown in the figures were made using EVA injection molding techniques. A mold of each of the animal shoes were precision machined to form the inverse of the figure. Molten EVA was injected at high pressure into a mold to form the shoe. Snaps were added to the straps for securing the strap to the shoe.

A corresponding PCT application is being filed concurrently herewith and is entitled "SHOES" by Joel Rusnak, filed on even date herewith, Application No. PCT/US 08/71921. The teachings of which are incorporated herein by reference in their entirety.

The relevant teachings of all the references, patents and/or patent applications cited herein are incorporated herein by reference in their entirety.

While this invention has been particularly shown and described with references to preferred embodiments thereof, it will be understood by those skilled in the art that various changes in form and details may be made therein without departing from the scope of the invention encompassed by the appended claims.

What is claimed is:

1. A shoe that comprises:

a. a sole that includes a bottom surface; and b. an upper having sides extending from the sole and a toe portion, wherein the sides and the toe portion comprise an outer surface that comprises a series of projections and recesses that form a three-dimensional animal or character figure with one or more features;

wherein the sole, and the upper which includes the sides, toe portion and the three-dimensional animal or character figure having the one or more features are a single piece substantially formed from a molded material.

2. The shoe of claim 1, wherein the sole has a bottom surface that comprises a series of projections and recesses that form a print to thereby form an imprinting surface, wherein the figure on the outer surface of the upper relates to the print of the imprinting surface.

3. A molded shoe featuring an animal, the shoe comprises:

a. a sole having a bottom surface that comprises a series of projections and recesses that form an animal print for an animal, to thereby obtain an animal imprinting surface; and b. an upper sides extend from the sole and a toe portion, wherein the sides and the toe portion comprise an outer surface that comprises a series of projections and recesses that form a three-dimensional animal figure with one or more features, wherein the upper, having the sides, the toe portion and the three-dimensional animal figure having the one or more features is molded into a single piece;

wherein the sole and upper are substantially formed from molded plastic; and the animal figure on the outer surface of the upper relates to the animal print of the animal imprinting surface.

4. The molded shoe of claim 3, wherein the material of the molded shoe is molded plastic that is made from recycled plastic.

5. The molded shoe of claim 3, wherein the animal featured is selected from the group consisting of: a ladybug, an alligator, a frog, a duck, a dinosaur, a bug, a turtle, a panther and a fish.

6. The molded shoe of claim 5, wherein the animal imprinting surface includes projections and recesses that form footprints of the featured animal.

7. The molded shoe of claim 6, wherein the animal imprinting surface has projections, recesses, or both that have a depth that ranges between about 2 mm to about 5 mm to thereby obtain an animal imprinting surface.

8. The molded shoe of claim 3, further including a strap for wrapping around the back of the ankle, wherein the strap has a first and second end attached to the upper.

9. The molded shoe of claim 3, wherein the upper includes a series of projections and recesses that form an animal figure that has eyes and a mouth.

10. The molded shoe of claim 9, wherein the upper further includes a series of projections and recesses that form an animal figure that has one or more of the following features: animal skin pattern, feathers, scales, nose, teeth, grass, legs, eyes, toes, feet, ears, fur, mouth, claws or any combination thereof.

11. A method of making an animal imprint on a surface with a molded shoe; the method includes;

a. stepping on the surface with a molded shoe featuring an animal, the shoe comprises:

i. a sole having a bottom surface that comprises a series of projections and recesses that form an animal print for an animal, to thereby obtain an animal imprinting surface; and ii. an upper having sides extending from the sole and a toe portion, wherein the sides and the toe portion comprise an outer surface that comprises a series of projections and recesses that form a three-dimensional animal figure with one or more features;

wherein the sole, and the upper which includes the sides, toe portion and the three-dimensional animal figure having the one or more features are a single piece substantially formed from molded plastic; and the animal figure on the outer surface of the upper relates to the animal print of the animal imprinting surface.

12. The method of claim 11, wherein the surface is a soft surface that includes dirt, mud, sand or clay.

13. A shoe that comprises:

a. a sole; and b. an upper having sides extending from the sole and a toe portion, wherein the sides and the toe portion comprise an outer surface that comprises a series of projections and recesses that form a three-dimensional figure with one or more features;

wherein the sole, the upper including the three-dimensional animal figure having the one or more features are a single piece substantially formed from a molded material.

14. The shoe of claim 13, wherein the sole has a bottom surface that comprises a series of projections and recesses that form a print for the figure, to thereby obtain a figure imprinting surface, wherein the figure on the outer surface of the upper relates to the print of the figure imprinting surface.

15. The shoe of claim 13, wherein the three dimensional figure comprises a character, likeness of a person, or an animal.

* * * * *